US010760834B2

(12) United States Patent
Hammer et al.

(10) Patent No.: US 10,760,834 B2
(45) Date of Patent: Sep. 1, 2020

(54) EVAPORATOR IN A REFRIGERANT CIRCUIT D

(71) Applicant: AUDI AG, Ingolstadt (DE)

(72) Inventors: Hans Hammer, Pfaffenhofen (DE); Predrag Hrnjak, Urbana, IL (US); Andrew Musser, Champaign, IL (US); Stefan Elbel, Urbana, IL (US); Wesley Schell, Mahomet, IL (US)

(73) Assignee: AUDI AG, Ingolstadt (DE)

( * ) Notice: Subject to any disclaimer, the term of this patent is extended or adjusted under 35 U.S.C. 154(b) by 139 days.

(21) Appl. No.: 16/121,746

(22) Filed: Sep. 5, 2018

(65) Prior Publication Data

US 2020/0072514 A1 Mar. 5, 2020

(51) Int. Cl.

| | |
|---|---|
| ***F25B 39/02*** | (2006.01) |
| ***F25B 43/00*** | (2006.01) |
| ***F28F 1/02*** | (2006.01) |
| ***F28F 9/02*** | (2006.01) |
| ***F28D 1/053*** | (2006.01) |
| ***F25B 5/02*** | (2006.01) |
| ***F28D 21/00*** | (2006.01) |

(52) U.S. Cl.

CPC ..... *F25B 39/028* (2013.01); *F25B 39/022* (2013.01); *F25B 43/00* (2013.01); *F28D 1/05391* (2013.01); *F28F 1/022* (2013.01); *F28F 9/0282* (2013.01); *F25B 5/02* (2013.01); *F25B 2339/0241* (2013.01); *F25B 2339/0242* (2013.01); *F25B 2400/23* (2013.01); *F28D 2021/0071* (2013.01); *F28D 2021/0085* (2013.01); *F28F 2260/02* (2013.01)

(58) Field of Classification Search

CPC .. F25B 2400/23; F25B 39/022; F25B 39/028; F25B 43/00

USPC ..... 62/515

See application file for complete search history.

(56) References Cited

U.S. PATENT DOCUMENTS

| | | | | |
|---|---|---|---|---|
| 7,832,231 | B2 | 11/2010 | Knight et al. | |
| 2008/0099191 | A1 | 5/2008 | Taras et al. | |
| 2011/0000255 | A1* | 1/2011 | Taras | F25B 39/028 62/498 |
| 2011/0017438 | A1* | 1/2011 | Huazhao | F28D 1/05383 165/174 |

(Continued)

FOREIGN PATENT DOCUMENTS

| | | | |
|---|---|---|---|
| EP | 2159514 | A2 | 3/2010 |
| JP | 2011237062 | A | 11/2011 |

(Continued)

*Primary Examiner* — Henry T Crenshaw

(74) *Attorney, Agent, or Firm* — Maier & Maier, PLLC

(57) ABSTRACT

An evaporator in a refrigerant circuit, having a bottom-side inlet chamber which is connected in flow terms to an evaporator outlet side via evaporator tubes, a separator being integrated into the evaporator inlet chamber, in which separator a refrigerant which is expanded in an expansion member is divided as a two-phase liquid/vapour mixture into a vapour phase and into a liquid phase which is separate therefrom, the vapour phase being conducted via a bypass line to the evaporator outlet side, and the liquid phase being conducted counter to the direction of gravity into the evaporator tubes, to be precise at least one evaporator tube being a flat tube with a plurality of micro-channels.

10 Claims, 6 Drawing Sheets

(56) References Cited

U.S. PATENT DOCUMENTS

| | | | | |
|---|---|---|---|---|
| 2011/0203308 | A1* | 8/2011 | Chiang | F25B 39/028 62/498 |
| 2015/0129160 | A1* | 5/2015 | Burk | B60H 1/3201 165/42 |
| 2015/0219375 | A1* | 8/2015 | Yu | F28D 1/05366 165/174 |
| 2015/0345843 | A1 | 12/2015 | Voorhis et al. | |
| 2017/0089642 | A1* | 3/2017 | Taras | F28F 9/0209 |

FOREIGN PATENT DOCUMENTS

| | | | |
|---|---|---|---|
| WO | 2006/083442 | A2 | 8/2006 |
| WO | 2015/073106 | A1 | 5/2015 |

* cited by examiner

EVAPORATOR IN A REFRIGERANT CIRCUIT D

FIELD

The invention relates to an evaporator in a refrigerant circuit, which evaporator can be used, for example, in a vehicle air conditioning system.

BACKGROUND

In a closed refrigerant circuit of this type, a compressor, a condenser and an expansion member are connected in addition to the evaporator. During air conditioning operation, the vaporous refrigerant which comes from the evaporator is compressed in the compressor and is conducted into the condenser. The condenser can be arranged by way of example in the front end of the vehicle and can be flowed through by the air stream, as a result of which the refrigerant which is situated in the condenser condenses into its liquid phase, to be precise with the dissipation of thermal energy to the air stream which is flowing through. The refrigerant which is then liquid is expanded in the downstream expansion member to form a two-phase liquid/vapour mixture which is fed to a separator. A phase separation takes place in the separator, in the case of which phase separation the liquid phase is separated from the vapour phase of the refrigerant. The vapour phase is conducted via a bypass line directly to the evaporator outlet. The liquid phase which is separated from the vapour phase is conducted through the heat exchanger tubes of the evaporator. During air conditioning operation, the evaporator (for example, a cross-counterflow heat exchanger) is flowed through by way of an air flow to be cooled which is guided into the vehicle interior compartment. The refrigerant liquid phase in the evaporator is therefore evaporated into the vapour phase with absorption of thermal energy from the air flow, while the air flow is cooled at the same time.

WO 2015/073106 A1 has disclosed an evaporator of the generic type which has a bottom-side inlet chamber which is connected in flow terms via evaporator tubes to an evaporator outlet side. A separator for a phase separation is integrated into the evaporator inlet chamber. The evaporator tubes are realised in each case as a flat tube with a plurality of micro-channels, through which the refrigerant is guided.

In WO 2015/073106 A1, the phase separation takes place in the separator by way of the use of centrifugal force. To this end, the two-phase liquid/vapour mixture is introduced into the evaporator inlet chamber in a vortex flow along the inner wall of a distributor tube. As a result, the vapour phase collects radially within the vortex flow, and the said vapour phase is fed to a bypass line. In contrast, the liquid phase collects radially on the outside at the vortex flow which is guided along the distributor tube inner wall. The use of centrifugal force is complicated in terms of process technology. In addition, a structurally complicated separator geometry is required.

U.S. Pat. No. 7,832,231B2 has disclosed an evaporator, the evaporator tubes of which are likewise realised as flat tubes with micro-channels. The evaporator has an upper-side (in the evaporator height direction) inlet chamber, into which a separator for a phase separation is integrated. EP 2 159 514 A2 has disclosed an evaporator, the evaporator tubes of which are likewise configured as flat tubes, into which in each case a plurality of micro-channels are integrated. Further evaporators are known from WO 2006/083442 A2 and from US 2015/0345843 A1.

SUMMARY

It is the object of the invention to provide an evaporator with a separator which is integrated into it, which evaporator operates simply in terms of process technology and is of structurally simple configuration.

In order to configure the separator, the micro-channels of the at least one evaporator flat tube can be divided into at least one vapour phase micro-channel which forms the bypass line and into at least one liquid phase micro-channel, into which the liquid phase which is collected in the inlet chamber flows.

In one technical implementation, the inlet chamber can be configured by way of a chamber bottom and side walls which are raised from it in the evaporator height direction and terminate at an upper chamber top wall. The evaporator flat tube can protrude downwards through the chamber top wall into the inlet chamber.

Here, the orifice openings of the micro-channels are spaced apart from the chamber bottom by a free spacing. In the case of an evaporator of this type, the liquid phase collects on the chamber bottom of the inlet chamber with a filling level. According to the invention, the free spacing between the orifice openings of the micro-channels and the chamber bottom is selected in such a way that the liquid phase micro-channel is dipped with its orifice opening into the liquid phase which is collected in the inlet chamber. In contrast, the vapour phase micro-channel is positioned with its orifice opening above the liquid phase level in the inlet chamber by a height offset.

The free spacing of the orifice opening of the vapour phase micro-channel from the chamber bottom can preferably be greater than the free spacing of the orifice opening of the liquid phase micro-channel.

In one specific design variant, the evaporator flat tube can have a right-angled flat profile cross section, to be precise with narrow sides and flat sides which lie opposite one another in each case. The micro-channels are arranged between the flat tube narrow sides in an aligned manner at least in one row behind one another in a parallel arrangement.

In the case of a flat tube construction of this type, the orifice openings of the micro-channels are configured on a flat tube end side which is, in particular, planar and faces the chamber bottom. With regard to a properly operating separator, it is preferred if the flat tube end side lies, in particular completely, in an oblique plane. The said oblique plane defines an oblique angle with a horizontal plane, as a result of which different free spacings result between the orifice openings of the micro-channels and the chamber bottom.

The evaporator can preferably be of plate-shaped configuration, to be precise with an inlet chamber which is elongate in an evaporator transverse direction. In this case, a plurality of evaporator flat tubes can be arranged behind one another and at a spacing from one another in the evaporator transverse direction in an aligned manner in a parallel arrangement. Intermediate spaces, through which air flows, are formed between the evaporator flat tubes, through which intermediate spaces the air flow to be cooled is guided during air conditioning operation. In the region of their orifice openings, all of the evaporator flat tubes can preferably have in each case identical separator geometries which are specified above.

In order to increase the degree of efficiency, the separator can have a distributor tube which extends within the inlet chamber in the evaporator transverse direction. The distributor tube can have a reduced cross section in comparison with the inlet chamber. During air conditioning operation, the two-phase liquid/vapour mixture flows via the distributor tube into the inlet chamber. The distributor tube can have at least one discharge opening which is assigned a deflector wall. During air conditioning operation, a refrigerant jet can therefore exit from the discharge opening and come into contact with the deflector wall, at which a phase separation takes place.

In one preferred design variant, the discharge opening can be configured on the outer circumference of the distributor tube and/or can be oriented upwards in the evaporator height direction. In this case, the chamber top wall can act in a structurally simple manner as a deflector wall, with which the refrigerant jet comes into contact.

With respect to a proper phase separation, it is advantageous if the distributor tube discharge opening is offset from the orifice openings of the evaporator flat tubes in the evaporator transverse direction by a transverse offset. In this case, the distributor tube discharge opening is directed directly onto the chamber top wall (which acts as a deflector wall), the refrigerant jet which exits being guided past the orifice openings of the micro-channels.

By way of the component geometry which is described in the following text, a pocket-shaped phase separation space can be provided, with the aid of which the phase separation in the separator is increased further. The evaporator flat tubes can thus protrude in each case with a tube projection from the chamber top wall downwards into the inlet chamber. The mutually facing flat sides of the tube projections, the chamber top wall and the chamber side walls which lie opposite one another in the evaporator depth direction delimit the pocket-shaped phase separation space. The refrigerant jet which exits from the distributor tube discharge opening is sprayed into the phase separation space.

With regard to perfect functionality of the separator, it is advantageous if the distributor tube protrudes beyond the liquid phase level in the inlet chamber at least with its discharge opening and is not dipped completely into the liquid phase which collects in the inlet chamber. In this case, the distributor tube can be positioned at least with its discharge opening in an inner corner region which is defined between the refrigerant liquid phase level and the flat tube end sides.

The evaporator can be configured as a cross-counterflow heat exchanger. Accordingly, as a first flat tube, the evaporator flat tube can be a constituent part of a first evaporator tube set. In the first evaporator tube set, the refrigerant is guided counter to gravity as far as into an upper deflecting chamber. From the upper deflecting chamber, the refrigerant is guided back further via at least one second flat tube which is a constituent part of a second evaporator tube set in the direction of gravity into a bottom-side outlet chamber. The bottom-side outlet chamber can be attached in flow terms to a suction side of the compressor.

The outlet chamber and the inlet chamber can preferably be arranged in a common bottom-side distributor housing of the evaporator. In the case of flow guidance of this type, the first flat tube (which leads to the deflecting chamber) and the second flat tube (which leads to the outlet chamber) can be arranged behind one another in an aligned manner in an evaporator depth direction. Here, the first and second flat tubes are positioned in such a way that their flat sides lie in each case in vertical planes which are defined between the evaporator depth direction and the evaporator height direction. In one technical realisation, the first flat tubes in the first evaporator tube set and the second flat tubes in the second evaporator tube set can be provided in identical numbers.

In the following text, a preferred geometry of the evaporator flat tube will be described, in the case of which preferred geometry the flat tube narrow sides are spaced apart from one another over a flat tube width. The flat tube flat sides are spaced apart from one another over a flat tube thickness. With regard to a perfect functionality of the separator and to a high degree of efficiency of the evaporator, it is preferred if the number of micro-channels in the first flat tube (assigned to the first evaporator tube set) is greater than in the second flat tube (assigned to the second evaporator tube set). As an alternative and/or in addition, the flat tube width of the first flat tube can be greater than the flat tube width of the second flat tube. As an alternative and/or in addition, the flat tube thickness of the first flat tube can be smaller than the flat tube thickness of the second flat tube.

Each micro-channel of the first/second flat tube has a micro-channel flow cross section. The micro-channel flow cross sections of all the micro-channels of the first/second flat tube can preferably be of identical configuration.

It is preferred if the micro-channels of the first flat tube provide an overall flow cross section which is greater than an overall flow cross section which is provided by the micro-channels of the second flat tube. In one specific design variant, the number of micro-channels in the first flat tube can lie, for example, at 29. The number of micro-channels in the second flat tube can lie at 19. The flat tube width of the first flat tube can be 20 to 30 mm, preferably 25 to 27 mm, by way of example, whereas the flat tube width of the second flat tube can be 10 to 20 mm, preferably 15 to 18 mm. In addition, the flat tube thickness of the first flat tube can possibly lie at 1.2 to 1.3 mm, preferably 1.25 to 1.28 mm, whereas the flat tube thickness of the second flat tube can lie at 1.3 to 1.4 mm, preferably 1.35 to 1.38 mm.

On account of the phase separation which takes place in the separator, the pressure loss in the evaporator is reduced considerably during air conditioning operation. Consequently, the flow cross section which is provided by the micro-channels can preferably be reduced. A reduction of this type of the micro-channel flow cross section is accompanied by only a slightly increased evaporator pressure loss.

During air conditioning operation, the liquid phase which collects in the inlet chamber flows into the liquid phase micro-channel, and said liquid phase can evaporate into a vapour bubble at least partially in the further flow path through the liquid phase micro-channel. This results in the problem that the pressure loss rises in the liquid phase micro-channel, and the vapour bubble which forms is possibly pressed back into the inlet chamber in the opposite direction to the flow. A vapour return flow of this type impairs the degree of efficiency of the evaporator.

Against this background, a vapour return flow preventer is configured in the region of the orifice opening of the liquid phase micro-channel. The vapour return flow of the vapour bubble which is formed in the liquid phase micro-channel back into the inlet chamber can be prevented by way of the vapour return flow preventer.

In one embodiment which is simple in terms of production technology, the vapour return flow preventer is a restricting orifice, by means of which the flow cross section of the orifice opening is reduced in comparison with the remaining micro-channel flow cross section. In order to reliably prevent a vapour return flow, it is preferred if the flow cross section is reduced at the micro-channel orifice opening by up to from 50% to 75%.

BRIEF DESCRIPTION OF THE DRAWINGS

In the following text, one exemplary embodiment of the invention is described using the appended figures, in which.

DETAILED DESCRIPTION

Figure 1:
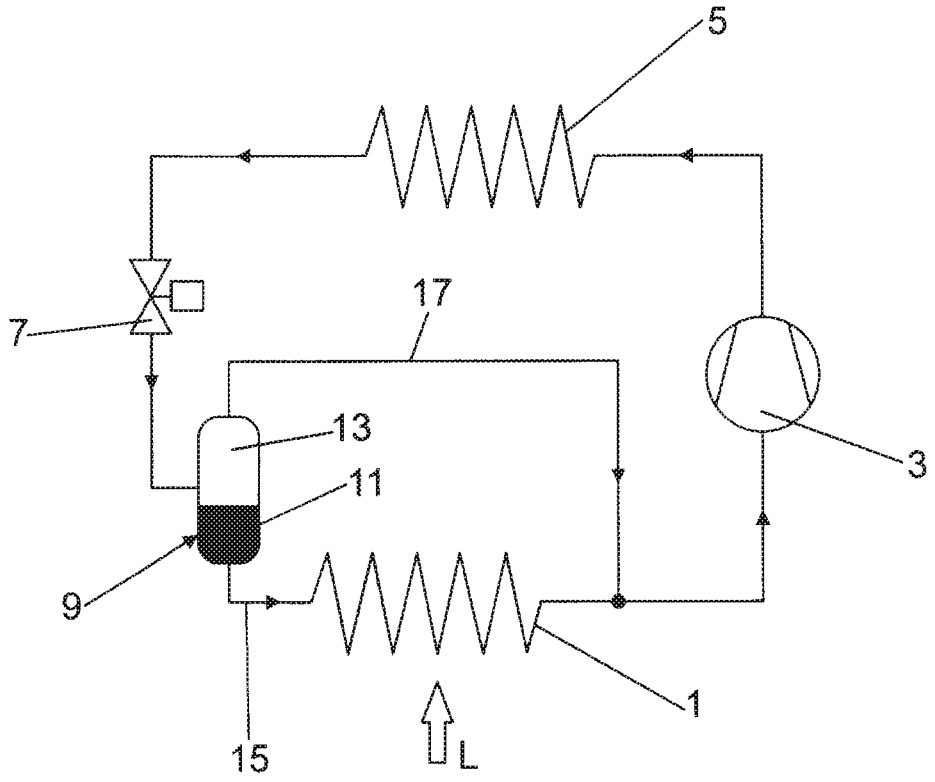
Fig. 1 (prior art)
FIG. 1 shows a block circuit diagram of a refrigerant circuit of a vehicle air conditioning system.

FIG. 1 shows a closed refrigerant circuit for, for example, a vehicle air conditioning system. An evaporator 1, a compressor 3, a condenser 5 and an expansion member 7 are connected into the refrigerant circuit. A separator 9 is connected between the expansion member 7 and the evaporator 1, in which separator 9 a phase separation takes place. During air conditioning operation, a vaporous refrigerant which comes from the evaporator 1 is compressed in the compressor 3 and is conducted into the condenser 5. The condenser 5 can be arranged by way of example in the front end of the vehicle and can be flowed through by the air stream. As a result, the refrigerant condenses into its liquid phase with the dissipation of thermal energy. The liquid refrigerant is expanded in the expansion member 7 which is connected downstream in flow terms to form a two-phase liquid/vapour mixture 10 (FIG. 7) which is fed to the separator 9. In the separator 9, the liquid phase 11 of the refrigerant is separated from its vapour phase 13. The liquid phase 11 is fed via a low-pressure line 15 (FIG. 1 or 2) to the evaporator 1, whereas the vapour phase 13 is guided via a bypass line 17 to the outlet side 22 (FIG. 3) of the evaporator 1. During air conditioning operation, the evaporator 1 is flowed through by an air flow L which is guided into the vehicle interior compartment and provides thermal energy while being cooled, by means of which thermal energy the refrigerant liquid phase 11 evaporates into the vapour phase 13 in the evaporator 1. The vapour phase 13 which is produced in the evaporator 1 is conducted via the evaporator outlet 22 to the suction side of the compressor 3.

Figure 2:
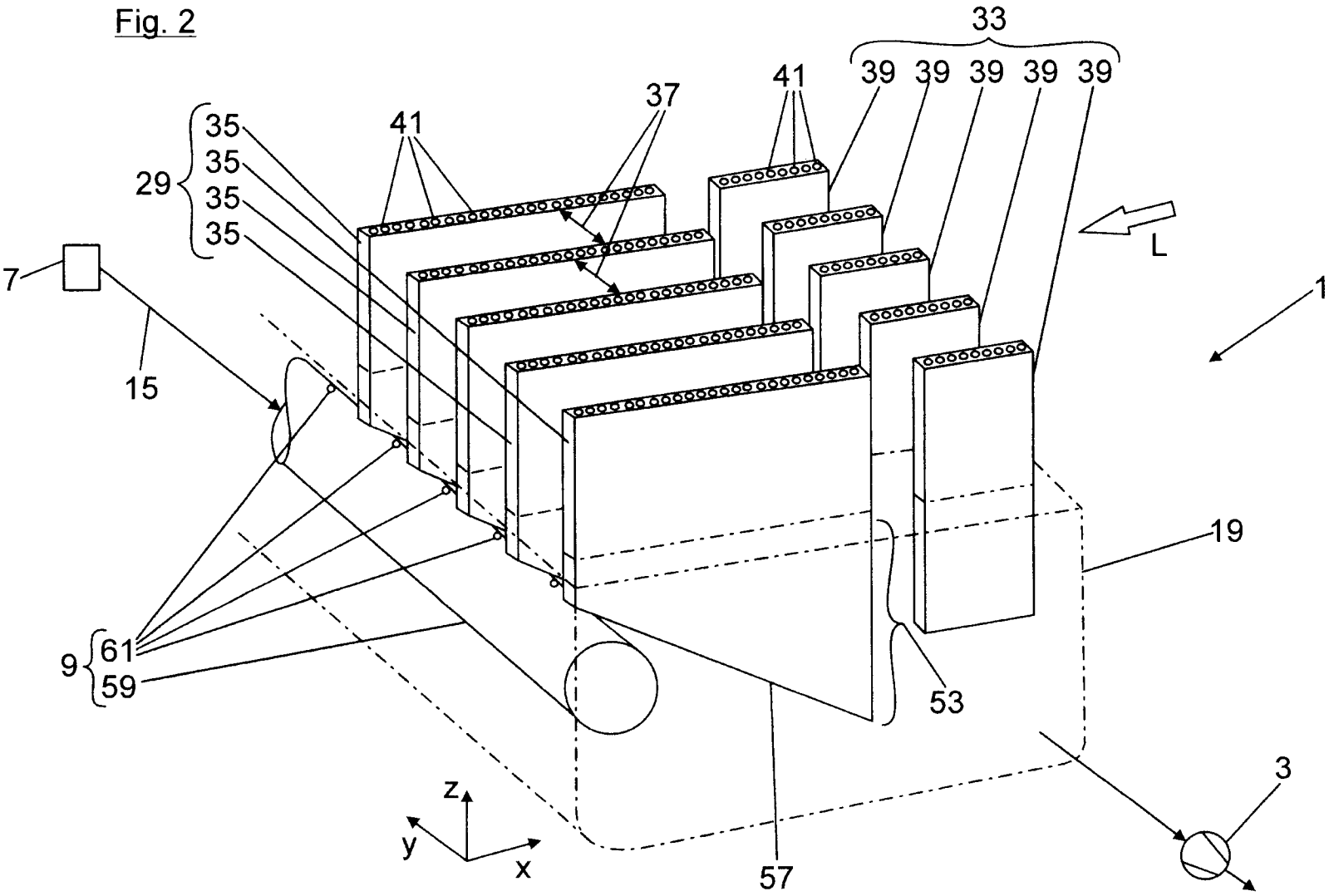
FIG. 2 shows a roughly diagrammatic perspective part view of the evaporator which is connected into the refrigerant circuit.

FIG. 2 indicates the evaporator 1 structurally in a perspective illustration to the extent that it is required for understanding the invention. Accordingly, the evaporator 1 has a bottom-side distributor housing 19 which is divided in FIG. 3 into an inlet chamber 21 and into an outlet chamber 23 which are separated from one another in a fluid-tight manner via a dividing wall 25. The separator 9 which will be described later is integrated into the evaporator inlet chamber 21, into which separator 9 the refrigerant which is expanded to a low pressure in the expansion member 7 is introduced as a two-phase liquid/vapour mixture 10 (FIG. 7) and is separated into the vapour phase 13 and into the liquid phase 11 which is separate therefrom.

Figure 3:
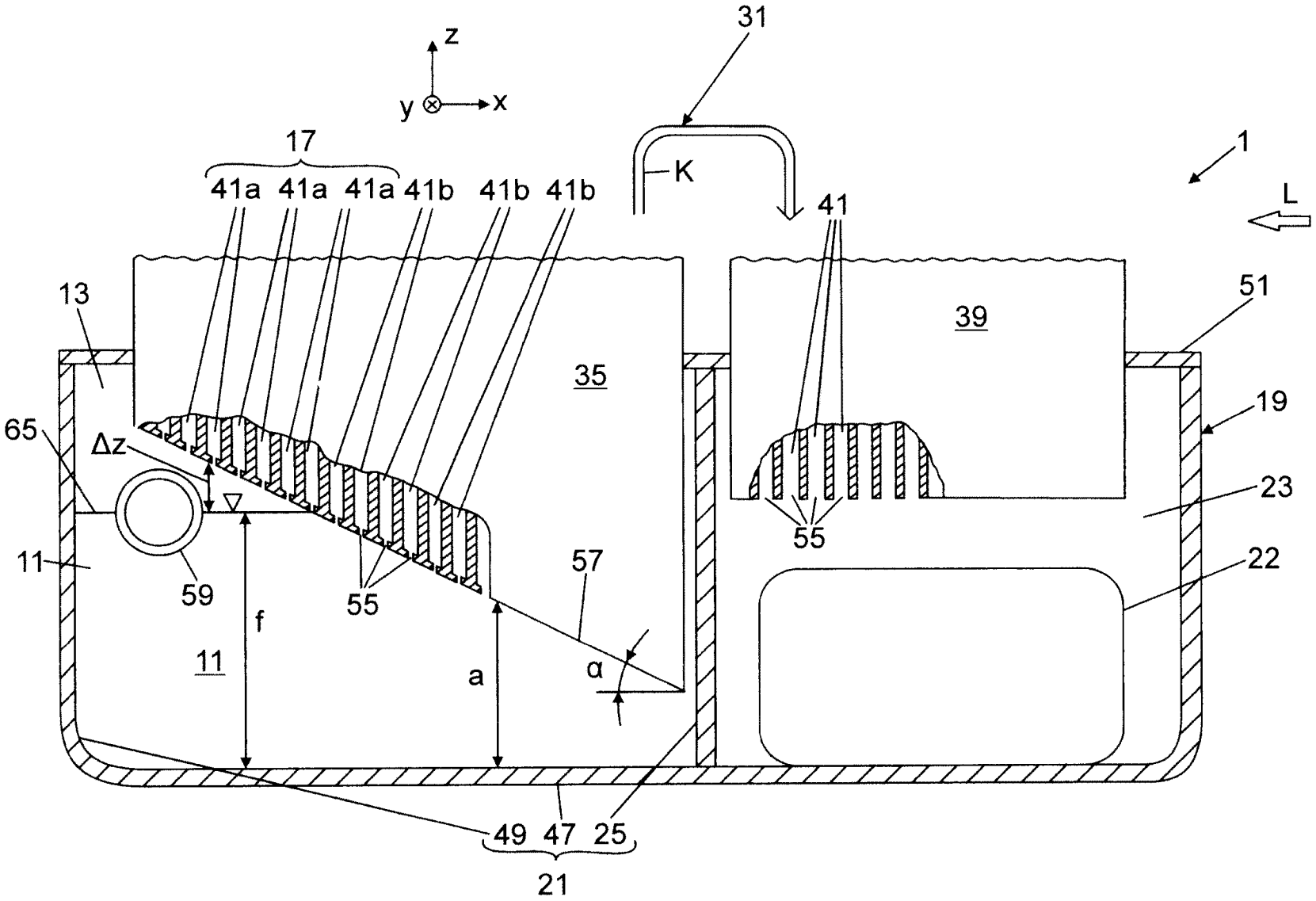
FIG. 3 shows details of a side sectional view of the evaporator.

In FIG. 2, the evaporator 1 has a first evaporator tube set 29, in which the refrigerant which is collected in the bottom-side inlet chamber 21 is conducted in an evaporator height direction z (that is to say, counter to the direction of gravity) as far as into an upper-side deflecting chamber 31 which is indicated in FIG. 3. In the deflecting chamber 31, the refrigerant flow path K is deflected, as shown by way of an arrow in FIG. 3. The refrigerant is returned from the upper-side deflecting chamber 31 via a second evaporator tube set 33 (FIG. 2) into the bottom-side outlet chamber 23 (FIG. 3). The outlet chamber 23 is flow-connected via the evaporator outlet side 22 to the suction side of the compressor 3.

The evaporator 1 which is shown in the figures is realised as a cross-counterflow evaporator. Accordingly, the air flow L which is to be cooled and is guided into the vehicle interior compartment is guided in a crossflow first of all through the second evaporator tube set 33 and then through the first evaporator tube set 29.

In accordance with FIG. 2, the bottom-side distributor housing 19 of the evaporator 1 is of elongate configuration in an evaporator transverse direction y. A plurality of first flat tubes 35 which are constituent parts of the first evaporator tube set 29 are arranged behind one another and at a spacing in the evaporator transverse direction y in an aligned manner in a parallel arrangement, to be precise with the formation of intermediate spaces 37, through which air flows. In FIG. 2, the second evaporator tube set 33 has second flat tubes 39. Each of the second flat tubes 39 is arranged in alignment behind a corresponding first flat tube 35 in each case in an evaporator depth direction x. The number of first flat tubes 35 in the first evaporator tube set 29 and the number of second flat tubes 39 in the second evaporator tube set 33 are identical.

Figure 5:
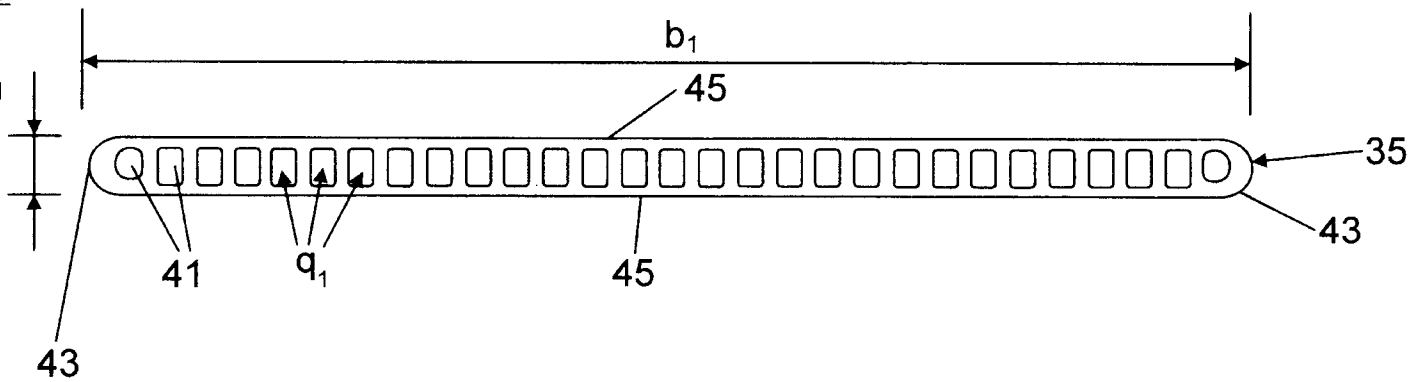
FIG. 5 shows a detailed view of the evaporator.
Figure 6:
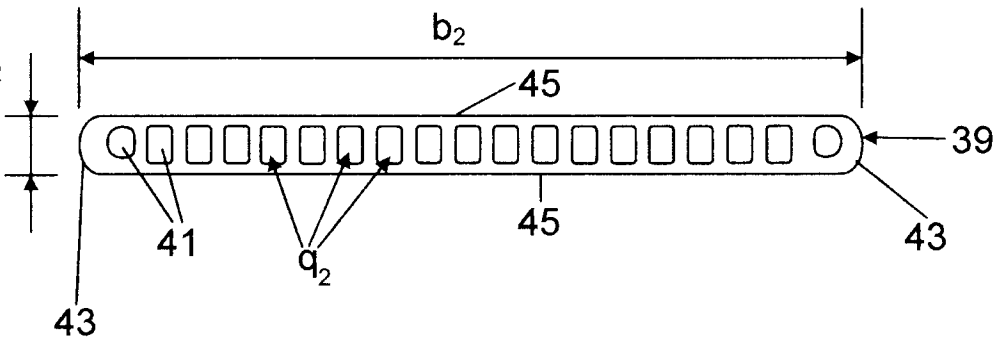
FIG. 6 shows another detailed view of the evaporator.

FIGS. 5 and 6 in each case show a first flat tube 35 and a second flat tube 39 in cross section. Accordingly, the two flat tubes 35, 39 in each case have a number of micro-channels 41. In FIGS. 5 and 6, the flat tubes 35, 39 are configured with a right-angled flat profile cross section, to be precise with narrow sides 43 and flat sides 45 which lie opposite one another in each case. The narrow sides 43 of the flat tubes 35, 39 are spaced apart from one another over a flat tube width $b_1$, $b_2$, whereas the flat tube flat sides 45 are spaced apart from one another over a flat tube thickness $d_1$, $d_2$. The micro-channels 41 extend in the respective flat tube 35, 39 between the flat tube narrow sides 43 which lie opposite one another, to be precise behind one another in an aligned manner in one row and in a parallel arrangement.

As is apparent from FIG. 3, the inlet chamber 21 is delimited in a fluid-tight manner by a chamber bottom 47, side walls and dividing walls 49, 25 which are raised from it in the evaporator height direction z, and a chamber top wall 51. The first evaporator flat tubes 35 protrude downwards through the chamber top wall 51 into the inlet chamber 21, to be precise in each case with a tube projection 53 (FIG. 2). The bottom-side orifice openings 55 of the micro-channels 41 of the first flat tubes 35 are spaced apart from the chamber bottom 47 over free spacings a (FIG. 3).

In the following text, the construction and the method of operation of the separator 9 will be described using FIG. 3. Accordingly, the orifice openings 55 of the micro-channels 41 of the first flat tube 35 which is shown are configured in a planar, obliquely set flat tube end side 57 which lies completely in an oblique plane. The said oblique plane defines an oblique angle $\alpha$ with a horizontal plane.

Figure 4:
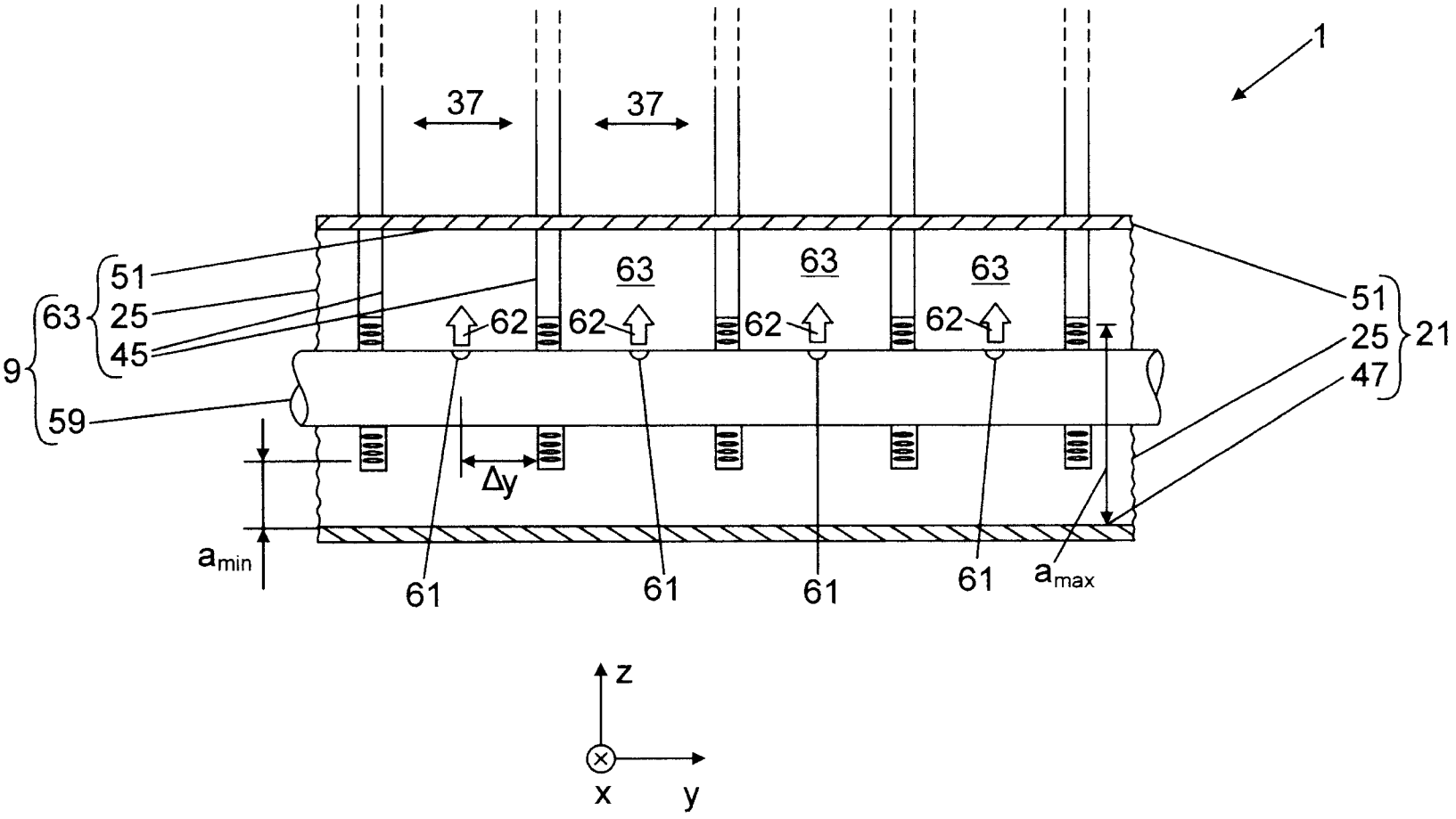
FIG. 4 shows details of a side sectional view of the evaporator.

This results in a wedge-shaped separator geometry, in the case of which an inner micro-channel 41 which faces the dividing wall 25 is spaced apart from the chamber bottom 47 at a minimum spacing $a_{min}$ (FIG. 4), and an outer micro-channel 41 in the evaporator depth direction x is spaced apart from the chamber bottom 47 at a maximum spacing $a_{max}$ (FIG. 4).

The above-described separator geometry is designed in such a way that, in every operating situation, the filling level f (FIG. 3) of the liquid phase 11 which is collected in the inlet chamber 21 is greater than the minimum spacing $a_{min}$. Consequently, during air conditioning operation, the micro-channels 41 of the flat tube 35 are divided into at least one vapour phase micro-channel 41*a* which is flowed through exclusively by the vapour phase 13, and into at least one liquid phase micro-channel 41*b*, into which exclusively the liquid phase 11 flows. That filling level f of the liquid phase 11 which is shown in FIG. 3 results by way of example in the seven partially shown vapour phase micro-channels 41*a*. The latter are positioned above the liquid phase level 65 and therefore form the bypass line 17. In addition, the six partially shown liquid phase micro-channels 41*b* result in FIG. 3. Exclusively the liquid phase 11 flows into the liquid phase micro-channels 41*b*. The obliquely positioned flat tube end side 57 therefore dips partially into the liquid phase 11 which is collected in the inlet chamber 21, and partially protrudes beyond the liquid phase level 65 of the liquid phase 11.

In addition, the separator 9 has a distributor tube 59. The distributor tube 59 extends in the inlet chamber 21 in the evaporator transverse direction y and is configured with a reduced cross section in comparison with the inlet chamber 21. The distributor tube 59 has discharge openings 61 which are arranged behind one another on the outer circumference in each case at a spacing and are oriented upwards in the evaporator height direction z, to be precise in the direction of the chamber top wall 51. Via the distributor tube 59, the two-phase liquid/vapour mixture 10 flows into the inlet chamber 21, to be precise via the discharge openings 61. A refrigerant jet 62 (indicated by way of an arrow in FIG. 4) exits in each case from the discharge openings 61. The refrigerant jet 62 comes into contact with the chamber top wall 51 which acts as a deflector wall. A phase separation takes place in the case of the contact of the refrigerant jet 62 with the chamber top wall 51. In order to further assist the said phase separation, the discharge openings 61 are arranged offset by a transverse offset Δy (FIG. 4) with respect to the first flat tubes 35 as viewed in the evaporator transverse direction y. This ensures that the refrigerant jets 62 which exit come directly into contact with the chamber top wall 51 and are conducted past the orifice openings 55 of the micro-channels 41 of the first flat tubes 35.

In order to further increase the phase separation, each refrigerant jet 62 is assigned a pocket-shaped phase separation space 63 which is open towards the bottom and into which the refrigerant jet 62 is sprayed. The phase separation space 63 is delimited by the mutually facing flat sides 45 of the tube projections 53 of the first flat tubes 35, by the chamber top wall 51 and by the side wall 49 and the dividing wall 25.

Figure 7:
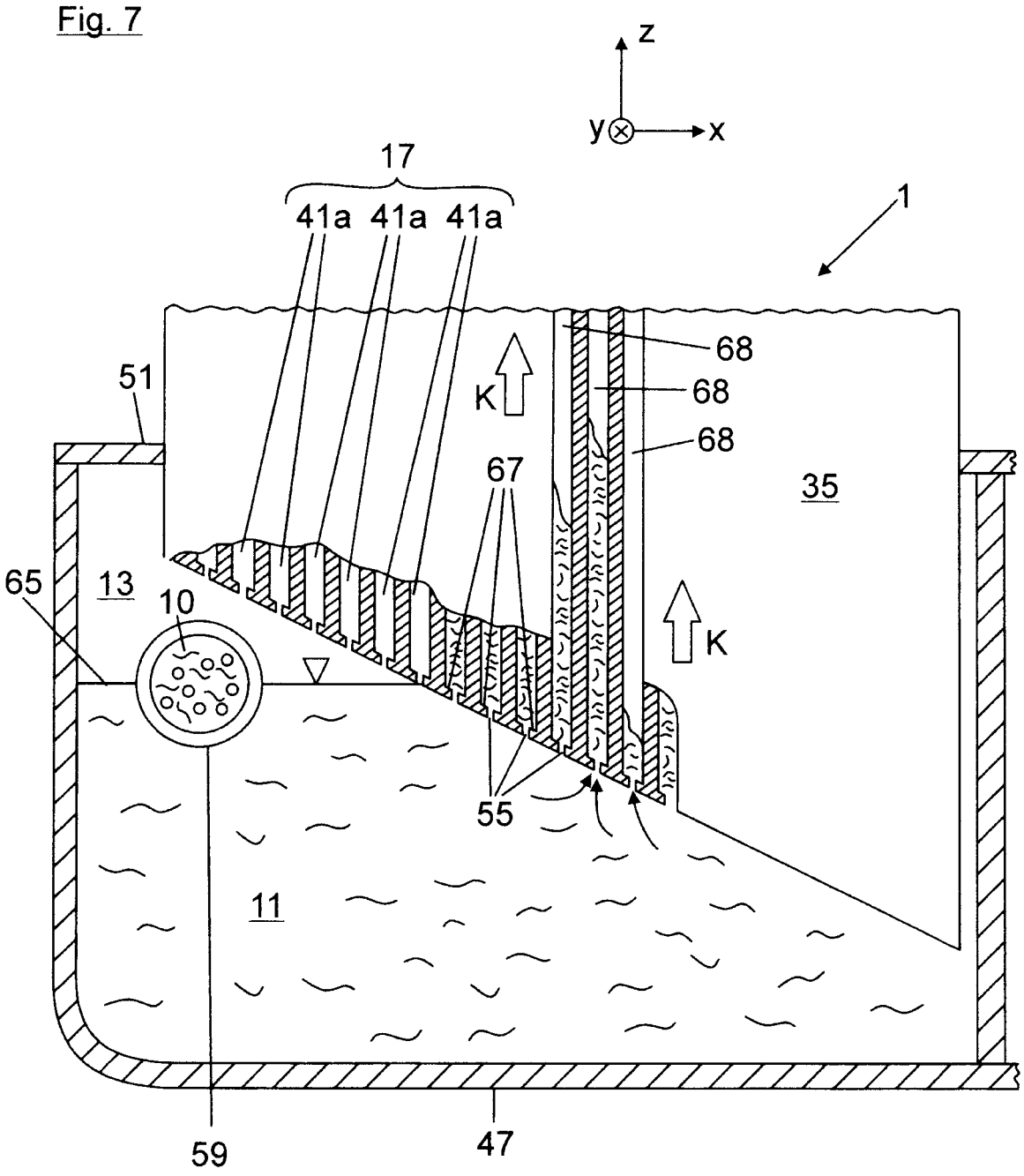
FIG. 7 shows another detailed view of the evaporator.

In order not to impair the functional capability of the separator 9, the distributor tube 59 is to be positioned in the inlet chamber 21 in such a way that at least its discharge openings 61 protrude beyond the liquid phase level 65, as shown in FIG. 3 or 7. Accordingly, the distributor tube 59 is positioned at least with its discharge openings 61 in an inner corner region. The latter is defined between the liquid phase level 65 and the obliquely set flat tube end side 57.

FIG. 5 shows one of the first flat tubes 35 in cross section. Accordingly, the first flat tube 35 has a total of 20 to 38, for example 29, micro-channels 41, the flat tube width $b_1$ being 27 mm and the flat tube thickness $d_1$ lying at 1.28 mm. In contrast to this, FIG. 6 shows one of the second flat tubes 39 in cross section. Accordingly, the number of micro-channels 41 in the second flat tube 39 lies at 10 to 28, for example 19, whereas the flat tube width $b_2$ lies at 18 mm, and the flat tube thickness $d_2$ is 1.35 mm.

On account of the highly efficient phase separation which takes place in the separator 9, the flow cross section which is provided by the micro-channels 41 can be reduced substantially in comparison with the prior art. The micro-channel cross section $q_1$ in the first flat tube 35 thus lies at (0.5 to 0.6 mm, preferably 0.55 to 0.57 mm)×(0.6 to 0.8 mm, preferably 0.7 to 0.75 mm), all of the micro-channels 41 in the first flat tube 35 having substantially identical micro-channel cross sections $q_1$. In the second flat tube 39, the micro-channel cross section $q_2$ lies at (0.6 to 0.8 mm, preferably 0.7 to 0.75 mm)×(0.5 to 0.65 mm, preferably 0.55 to 0.6 mm), all of the micro-channels 41 in the second flat tube 35 having substantially identical micro-channel cross sections $q_2$.

As is further apparent from FIG. 7, during air conditioning operation, the liquid phase 11 which is collected in the inlet chamber 21 flows into the liquid phase micro-channels 41*b*. In the further flow path towards the top, the liquid phase 11 which has flowed in can evaporate at least partially into a vapour bubble 68. In a case of this type, there is the risk that the vapour bubble 68 is returned into the inlet chamber 21 counter to the refrigerant flow direction. In order to prevent a vapour return flow of this type into the inlet chamber 21, restricting orifices 67 (FIG. 7) are configured in the region of the orifice openings 55 of the micro-channels 41 of the respective first flat tube 35. The said restricting orifices 67 act as vapour return flow preventers which prevent a return flow of the vapour bubbles 68 which are formed in the liquid phase micro-channels 41*b* into the inlet chamber 21. Here, the flow cross section at the restricting orifices 67 is reduced by approximately from 50% to 75% in comparison with the remaining micro-channel flow cross section.

The invention claimed is:

1. An evaporator in a refrigerant circuit, comprising:

an inlet chamber which is fluidly connected to an evaporator outlet chamber via evaporator tubes, and a separator integrated into the inlet chamber, the separator having an expansion member in which a refrigerant is expanded as a two-phase liquid/vapour mixture and then divided into a vapour phase and into a liquid phase which is separate therefrom, wherein the vapour phase is conducted via a bypass line to the evaporator outlet chamber, wherein the liquid phase is conducted counter to the direction of gravity into the evaporator tubes, wherein at least one of the evaporator tubes is formed as a flat tube with a plurality of micro-channels, through which the refrigerant is guided, each of the plurality of micro-channels having at least one orifice opening, wherein, during air conditioning operation, the liquid phase flows into the micro-channels and evaporates at least partially into a vapour bubble in a further flow path, and wherein the micro-channels are configured to prevent a return flow of the vapour bubble which is formed in the micro-channels into the inlet chamber.

2. The evaporator according to claim 1, wherein the micro-channels of the flat tube are divided into at least one vapour phase micro-channel and into at least one liquid phase micro-channel, and wherein the vapour phase micro-channel forms the bypass line, and exclusively the liquid phase flows into the liquid phase micro-channel.

3. The evaporator according to claim 2, wherein the inlet chamber is delimited by a chamber bottom, side walls which are raised from the chamber bottom in the evaporator height direction, and a chamber top wall, wherein the evaporator tubes protrude through the chamber top wall into the inlet chamber in the evaporator height direction in such a way that the orifice openings of the micro-channels are spaced apart from the chamber bottom by a spacing, wherein the liquid phase collects in the inlet chamber with a filling level, wherein the liquid phase micro-channel is dipped with at least one of the orifice openings into the liquid phase which is collected in the inlet chamber, and wherein the vapour phase micro-channel is positioned with its orifice opening above the liquid phase level by a height offset.

4. The evaporator according to claim 3, wherein the orifice opening of the vapour phase micro-channel is spaced from the chamber bottom to a greater extent than the spacing of the orifice opening of the liquid phase micro-channel.

5. The evaporator according to claim 3, wherein the orifice openings of the micro-channels are configured in a flat tube end side which is planar and faces the chamber bottom, and wherein the flat tube end side lies in an oblique plane which defines an oblique angle with a horizontal plane so that different spacings between the orifice openings of the micro-channels and the chamber bottom are formed.

6. The evaporator according to claim 5, wherein the spacings of the orifice openings of the micro-channels from the chamber bottom lie between a minimum spacing and a maximum spacing, and in that the minimum spacing is dimensioned in such a way that the filling level of the liquid phase which is collected in the inlet chamber is at least greater than the minimum spacing.

7. The evaporator according to claim 1, wherein the inlet chamber is elongated in an evaporator transverse direction, wherein the evaporator has a plurality of evaporator tubes which are arranged behind one another and at a spacing in the evaporator transverse direction in an aligned manner in a parallel arrangement, wherein the parallel arrangement results in the formation of intermediate spaces between each evaporator tube, through which air can flow and which are arranged outside the inlet chamber, and wherein the evaporator tubes each have an identical separator geometry in the region of their respective orifice openings.

8. The evaporator according to claim 1, wherein the separator has a distributor tube which extends in the inlet chamber in an evaporator transverse direction the distributor has a reduced cross section in comparison with the inlet chamber, and wherein the two-phase liquid/vapour mixture flows via the distributor tube into the inlet chamber, characterized in that the distributor tube has at least one discharge opening which is directed at a deflector wall, so that during operation, a refrigerant jet exiting from the discharge opening comes into contact with the deflector wall, resulting in a phase separation.

9. The evaporator according to claim 1, wherein the micro-channels are provided with a vapour flow preventer formed as a restricting orifice in the region of the orifice openings of the micro-channels, by means of which a flow cross section at the orifice opening is reduced in comparison with a remaining micro-channel flow cross section in order to prevent the return flow of the vapour bubble.

10. The evaporator according to claim 1, wherein a flow cross section at the orifice opening is reduced up to 50% to 75%.

* * * * *